US007998900B2

(12) United States Patent
Wyres et al.

(10) Patent No.: US 7,998,900 B2
(45) Date of Patent: Aug. 16, 2011

(54) PHOTOTHERMAL RECORDING MEDIUM

(75) Inventors: Christopher Anthony Wyres, Cheshire (GB); Nazir Khan, Nottingham (GB)

(73) Assignee: Datalase Ltd., Cheshire (GB)

( * ) Notice: Subject to any disclaimer, the term of this patent is extended or adjusted under 35 U.S.C. 154(b) by 978 days.

(21) Appl. No.: 11/666,919

(22) PCT Filed: Nov. 11, 2005
(Under 37 CFR 1.47)

(86) PCT No.: PCT/GB2005/004355

§ 371 (c)(1),
(2), (4) Date: Oct. 11, 2007

(87) PCT Pub. No.: WO2006/051309

PCT Pub. Date: May 18, 2006

(65) Prior Publication Data

US 2009/0023585 A1 Jan. 22, 2009

(30) Foreign Application Priority Data

Nov. 12, 2004 (GB) ..... 0425060.1
May 6, 2005 (GB) ..... 0509304.2

(51) Int. Cl.
*B41M 5/136* (2006.01)

(52) U.S. Cl. ..... 503/201; 430/945; 503/218

(58) Field of Classification Search ..... None
See application file for complete search history.

(56) References Cited

U.S. PATENT DOCUMENTS

| | | | |
|---|---|---|---|
| 3,936,307 | A | 2/1976 | Asakawa et al. |
| 4,657,844 | A | 4/1987 | Shu et al. |
| 5,811,369 | A | 9/1998 | Nagai et al. |
| 6,004,719 | A | 12/1999 | Gaudiana et al. |

FOREIGN PATENT DOCUMENTS

| | | | |
|---|---|---|---|
| GB | 2 196 137 | A | 4/1988 |
| JP | 61-151531 | A | 7/1986 |
| JP | 62-196652 | A | 8/1987 |
| JP | 63 221086 | A | 9/1988 |
| WO | WO 03/059295 | | 7/2003 |

OTHER PUBLICATIONS

Database WPI, "Sensitization of Direct Printing Recording Material by Forming Charge-Transfer Complex Between N-Vinyl Compound and Organic Halide" Jul. 19, 1975, pp. 33, *Derwent Publications Ltd.*, London, GB.

*Primary Examiner* — Bruce H Hess
(74) *Attorney, Agent, or Firm* — Saliwanchik, Lloyd & Eisenschenk

(57) ABSTRACT

A colorless or transparent composition comprises a charge-delocalization compound and a photoacid, wherein the photoacid generates an acid on irradiation or heating, thereby forming a colored change-transfer complex with said compound.

18 Claims, No Drawings

PHOTOTHERMAL RECORDING MEDIUM

This application is a National Stage Application of International Application Number PCT/GB2005/004355, filed Nov. 11, 2005; which claims priority to Great Britain Application No. 0425060.1, filed Nov. 12, 2004 and Great Britain Application No. 0509304.2, filed May 6, 2005.

FIELD OF THE INVENTION

This invention relates to photothermal recording medium.

BACKGROUND OF THE INVENTION

WO02/068205, WO02/074548, WO2004/043704 and WO2005/012442, and also corresponding patent applications claiming the same priority dates, including U.S. patent applications Ser. Nos. 10/344,393, 10/380,381 and 10/899,888 (the content of each of which is incorporated herein by reference), describe laser imaging and also materials that can be used for that purpose. Examples that are provided typically involve the use high energy lasers.

There are many attractions in using non-contact near-IR sources, in particular diode lasers, to generate images from coatings for applications such as variable information packaging. Favourable attributes of diode lasers such as economy, portability and ease of use, are attractive for current needs in the packaging industry, such as in-store labelling.

The use of ink formulations that incorporate materials which absorb radiation from far-IR to mid-IR sources such as heat (~1 to 20 μm) and $CO_2$ laser (~10 μm), allows the production of coatings that will generate a distinct coloured image on exposure to this wavelength of energy but not near-IR sources. The use of ink formulations that incorporate materials which absorb radiation from near-IR sources such as diode lasers (~1 μm), allows the production of coatings that will generate a distinct coloured image on exposure to near, mid or far-IR irradiation.

The use of carbazoles and related compounds in substrate marking is known. U.S. Pat. No. 3,936,307A discloses multilayer coating with reactive moieties, including electron donors, in each of separate layers. GB2196137A, JP63221086A and U.S. Pat. No. 5,811,369A also disclose heterogeneous compositions.

Derwent WPI, Week 197533 (19 Jul. 1975), XP002330401 (& JP50021087B), discloses sensitization of recording material by forming a charge-transfer complex between a N-vinyl compound and an organic halide. A radical-based colour-forming mechanism is apparently involved.

SUMMARY OF THE INVENTION

In accordance with an aspect of the present invention, a recording medium which is a colourless or transparent composition comprises a photo or thermally sensitive acid generator and a charge-delocalising compound, e.g. a basic compound capable of interacting with a cationic moiety, generated by stimulation of the acid generator, resulting in a shift of the spectral absorption characteristics of the irradiated region from the non-visible to the visible region of the electromagnetic spectrum. In this manner, a coloured image can be formed from a colourless transparent starting material using photo or thermal stimuli.

A product of the invention is a simple, homogeneous composition, and is particularly suitable for marking, e.g. using a laser, because it is colourless or transparent before being imaged. An effective contrast is obtained, and a wide variety/ range of monochrome colours is available, which depend on the materials used and charge delocalisation, and not on radical-based mechanisms. Compounds such as organic halides can be avoided.

Embodiments of the invention include photothermal imaging compositions, thermal imaging compositions, laser (UV, visible, NIR, $CO_2$) imageable compositions, photothermal imageable polymers, covert marking systems and negative imaging systems.

DESCRIPTION OF THE INVENTION

The charge-delocalising compound used in this invention preferably includes a heteroatom selected from N, O and S, and an aromatic group conjugated thereto. Thus, for example, it may be of the formula $Ar_1$—X—$Ar_2$, wherein each Ar is an aromatic group such as a benzene ring (unsubstituted or substituted) and X is the heteroatom. The Ar groups may be linked so that X is part of a further ring. An indole system may be preferred. If X is N, it will usually be further substituted by an alkyl or aromatic (but not necessarily vinylic) group, i.e. the compound is a tertiary amine which, when protonated, allows the positive charge to be delocalised. Specific examples of such compounds are carbazoles. Examples are given below.

The acid that is generated from the photoacid should be capable of protonating the amine or other charge-delocalising compound. It may be a superacid such as $HSbF_6$. The photoacid is preferably a salt of such an acid, in which the nature of the cation is relatively less critical.

A preferred method of forming a coloured image on a substrate comprises applying to the substrate a layer of a mixture of a basic compound and a photoacid generator, image-wise exposure to a UV light source, such as a lamp or a laser, followed by heating at 90° C. for 1 minute to reveal the image. Where the UV laser has sufficient power, monochrome images can be written directly, negating the requirement for an additional heating step; a preferred application of this technology is single-step UV laser imaging. The wavelength of the UV laser required is dictated by the absorbance of the photoacid. Consequently, formulations can be envisaged which are imageable by lasers having emission at any wavelength across the entire UV region. Similarly, the system can be sensitised to any wavelength by utilisation of a photoacid having appropriate absorption band(s) at that particular wavelength.

There are a multitude of other possible methods of producing images by combination of UV light sources and heat sources. For example, imagewise exposure to UV light, such as a laser or lamp, produces a latent image which can be revealed by exposure to an IR heating lamp. Alternatively, instead of the IR lamp, a thermal print-head or other heating element may be used.

A thermal print head may be used to write images into the sample, provided the sample, or the required patch/area of the sample, has been previously exposed to low power UV light. Alternatively, the thermal printhead could be replaced by a $CO_2$ laser, or any other laser capable of image-wise generation of heat. It is notable that a system operating in this mode can be sensitised to any wavelength by inclusion of substances capable of absorbing light of the given wavelength and generating heat. A preferred embodiment involves utilisation of a NIR diode laser for this role.

Any of a variety of substrates can be used. Examples include polymers, paper and foils.

The following are embodiments of the invention. "Carbazole" is used as an illustrative example of the charge-delocalising agent.

1. Carbazole+Photoacid Generator

By way of example, a mixture of N-ethyl carbazole and the photoacid generator Cyracure 6974 (triarylsulphonium hexafluoroantimonate in propylene carbonate) coated onto a substrate (PET, PP, paper, foil etc.), when exposed to UV light results in generation of a latent image, which is revealed by heating. The image is a blue/green colour, with the intensity of colouration dependent upon the intensity of the incident UV light.

Substitution of N-ethyl carbazole for other carbazoles, or other similar molecules results in generation of different colours/shades. A list of derivatives tested thus far and the corresponding colour produced is shown in Table 1.

TABLE 1

| Derivative | Colour |
|---|---|
| N-ethyl carbazole | Blue/green |
| Carbazole | green/blue |
| N-phenyl carbazole | green/blue |
| N-hydroxyethyl carbazole | Blue/green |
| Triphenylamine | green/grey |
| diphenylamine | pale green |
| 1,2-diphenylindole | pale brown |
| Dibenzothiophene | pale grey |
| Dibenzofuran | pale grey/blue |

2. Carbazole+Photoacid Generator+Binder

The colour-generating system of the invention can be incorporated into a wide range of printing/coating binders, such as acrylics, methacrylics, styrenics, alkyds, polyesters, cellulosics, polyethers, polyurethanes, polysiloxanes or polyolefins. However, the colour generated upon imaging typically does not correspond to that generated for films comprising solely of the active ingredients. It is evident that the colour produced is dependent upon the nature of the polymer matrix in which the colour-generating components are incorporated, facilitating manipulation of the resultant colour/shade. Examples are listed in the following Table 2.

TABLE 2

| Derivative | Binder | Colour |
|---|---|---|
| N-Ethylcarbazole | Nitrocellulose | Green |
| | UCAR VAGD | Cyan |
| | Polyvinylbutyrate | Lilac |
| | Elvacite 2028 | Green/blue |
| | Polyacrylonitrile | Pale green |
| | PVOH | Grey/black |
| | Polydimethylsiloxane-graft-polyacrylate | Pale blue |
| | Chorinated polyolefin | Blue/green |
| Carbazole | Nitrocellulose | Green |
| N-Phenylcarbazole | Nitrocellulose | Lime green |
| | Polyvinylbutyrate | Brown |
| N-2-hydroxyethylcarbazole | Nitrocellulose | Green |
| Triphenylamine | Nitrocellulose | Yellow |
| | Polyvinylbutyrate | Dark purple |
| | UCAR VAGD | Beige |
| | Polyacrylonitrile | Brown |
| Diphenylamine | Nitrocellulose | Green/yellow |
| | Polyvinylbutyrate | Purple |
| 1,2-Diphenylindole | Nitrocellulose | Yellow |
| | Polyvinylbutyrate | Brown |
| Dibenzothiophene | Nitrocellulose | Yellow/green |
| Dibenzofuran | Nitrocellulose | Beige |

3. Carbazole+Photoacid Generator+Binder+Additive

Given the dependency of the colour of the image upon the chemical nature of a host binder, it is logical to assume that the addition of other materials may affect the resultant colour. The effect of various additives upon the colour produced with a given combination of derivative, photoacid and binder has been investigated. The results for the effect of a range of additives upon N-ethyl carbazole and Cyracure 6974 in nitrocellulose are listed below, in Table 3.

TABLE 3

| Additive | Colour |
|---|---|
| No additive | Green |
| 2,6-di-tert-butyl-4-methylphenol | Black |
| Triphenylphosphine | yellow |
| Hydoquinone | brown |

It is evident that the colour for a particular combination of carbazole derivative, binder and photoacid can be manipulated by addition of a given compound, allowing the colour produced for a specific ink/coating formulation to be tailored as required.

4. Acid Generator/Counter-ion

The nature of the counter-ion may influence the colour produced. Use of a more nucleophilic counter-ion, hexafluorophosphate, in place of hexafluoroantimonate, results in production of images of considerably less intense colouration. Hence it can be inferred that the shade/colour may be altered by use of a different counter-ion or a combination of counter-ions.

The absorption of the photoacid generator dictates the wavelength of at which images can be written. Consequently, the system can be tuned to respond to sources emitting ultraviolet, visible or infra-red light, such as lamps or lasers, by use of a photoacid having an appropriate absorption band.

Use of an acid generator which undergoes thermally induced decomposition may make the imaging system compatible with thermal printing techniques. Similarly, the system may be susceptible to imaging with $CO_2$ lasers. Alternatively, the sensitivity may be tuned to any given wavelength by inclusion of a material having strong absorption at the corresponding wavelength. For example, a composition which included a well-known NIR absorber, copper hydroxide phosphate, after blanket exposure to low level UV, was rendered imageable by a NIR laser.

5. UV Curable Formulations

Inclusion of the colour generating components into a UV-curable formulation may allow simultaneous curing and colouration, allowing coloured films to be produced. Furthermore, the system may be utilised as a cure monitor or UV dositometer.

Similarly, use of a thermal acid generator, in place of the photoacid generator, extends potential use to thermal process indicators.

6. Polymeric Derivatives

The system described above involves doping monomeric derivatives into a host polymer. However, polymeric analogues of the active ingredients could be used, whereby the active ingredients are appended to or comprise a polymer backbone. For example, a formulation comprising polyvinylcarbazole and Cyracure 6974, where polyvinylcarbazole acts as both binder and carbazole derivative, when coated onto a substrate and irradiated/heated, yields green coloured images.

In another instance, the acid generator may comprise the polymer, with carbazole derivatives doped into this. Similarly, a blend of the polymeric acid generator and polymeric carbazole derivative may be utilised. Alternatively, a copolymer comprising repeat units having carbazole and/or acid-generating functionalities may be used.

The use of either a blend of polymers having acid-generating or carbazole-type functionalities, or a single copolymer having both functionalities, is very suitable, as films or articles may be extruded or cast directly from the polymer melt.

7. Covert Images

An image not visible to the naked eye can be written into a film of the imaging system and subsequently revealed on demand. This process involves imaging with a sufficiently low fluence level of UV light to ensure heating is minimised and hence colouration does not develop. The sample can then be heated, revealing the image when required. This process may find application in any area requiring hidden/covert marking, promotional messages, process indicators etc.

8. Negative Image

A negative image can be written into a film of a system as described above, whereby the imaged area remains uncoloured and the remainder develops colour upon blanket exposure to appropriate thermal or photo stimuli. The process typically involves writing an image in the sample by image-wise exposure to a suitable low fluence level light source, followed by exposure to ammonia vapours. The image can then be revealed by simultaneous blanket exposure to a suitable light source and heating.

In all of the above cases, the imaging system can be readily formulated in solvent or water-based ink and coating compositions and applied to any suitable substrate. Suitable solvents include methyl ethyl ketone, ethyl acetate, alcohols, alkyds, aromatics such as toluene or xylene, polar aprotic solvents such as dimethyl sulphoxide or N,N -dimethylformamide, and chlorinated solvents such as dichloromethane, chloroform or dichloroethane. Suitable binders include acrylics, methacrylics, styrenics, alkyds, polyesters, cellulosics, polyethers and polyurethanes. Suitable substrates include papers, polyethylene, polypropylene, polyesters and metals such as aluminium or steel.

The following Examples illustrate the invention.

EXAMPLE 1

A solution of 5 g N-ethylcarbazole and 10 g Cyracure 6974 (a solution of triarylsulphonium hexafluoroantimonate in propylene carbonate) in 85 g methyl ethyl ketone (MEK) was prepared. A uniform film of this material was applied to a substrate using a K-bar and allowed to dry thoroughly, resulting in a transparent colourless coating. A sample of the coated material was exposed to a broad band UV source for approximately 10 seconds, followed by heating in an oven at 90° C. for 1 minute, resulting in development of a turquoise/green colouration.

EXAMPLES 2 TO 19

The procedure of Example 1 was repeated, except that the amine and/or the 85 g MEK was replaced by a variety of other components. These components, and the colourations observed (together with the corresponding values of Example 1, for reference) are given below, in Table 4.

TABLE 4

| Example | Amine (5 g) | MEK (g) | Other Component (g) | Colouration |
|---|---|---|---|---|
| 1 | N-ethylcarbazole | 85 | none (0) | turquoise/green |
| 2 | N-ethylcarbazole | 64 | nitrocellulose (21) | dark green |
| 3 | N-ethylcarbazole | 64 | polyvinylbutyrate (21) | dark brown |
| 4 | N-ethylcarbazole | 85 | Elvacite 2028 (21) | blue/green |
| 5 | N-ethylcarbazole | 64 | UCAR (21) | green/blue |
| 6 | N-ethylcarbazole | 64 | Luran (21) | pale green |
| 7 | N-ethylcarbazole | 64 | Polydimethylsiloxane-Polyacrylate graft (21) | cyan |
| 8 | N-phenylcarbazole | 85 | None (0) | green |
| 9 | Carbazole | 85 | None (0) | green |
| 10 | Triphenylamine | 85 | None (0) | green |
| 11 | Diphenylamine | 85 | None (0) | green |
| 12 | N-phenyl-carbazole | 64 | Nitrocellulose (21) | lime green |
| 13 | Triphenylamine | 64 | Nitrocellulose (21) | yellow |
| 14 | Diphenylamine | 64 | Nitrocellulose (21) | yellow/green |
| 15 | Carbazole | 64 | Nitrocellulose (21) | green |
| 16 | 1,2-diphenylindole | 64 | Nitrocellulose (21) | yellow |
| 17 | Triphenylamine | 64 | Polyvinylbutyrate (21) | dark purple |
| 18 | N-phenylcarbazole | 64 | Polyvinylbutyrate (21) | brown |
| 19 | 1,2-diphenylindole | 64 | Polyvinylbutyrate (21) | brown |

EXAMPLE 20

Example 2 was repeated, but additionally using 10 g 2,6-di-tert-butyl-4-methylphenol. The colouration was green/black.

EXAMPLE 21

Example 2 was repeated, but additionally using 10 g hydroquinone. The colouration was brown.

EXAMPLE 22

Example 2 was repeated. The colouration was pale green.

EXAMPLE 23

UV Laser Imaging

Example 2 was repeated, except that images were written on a sample of the coating using a 266 nm laser at different fluence levels. In each case, a green image developed, with the intensity of colouration increasing with incident fluence level.

EXAMPLES 24 TO 26

UV Laser Imaging

Images were written as in Example 23, on coatings prepared in Examples 20, 3 and 13. Black, brown and yellow images developed, respectively, with the intensity of colouration increasing with increasing fluence level.

EXAMPLES 27 AND 28

$CO_2$ Imaging

Coatings were prepared as in Examples 3 and 2. The coatings were exposed to a broadband UV source for 5 seconds, resulting in development of very pale beige and green colourations, respectively. Images were then written on the samples using a $CO_2$ laser at different fluence levels. In each case a brown or green image developed, respectively, with the intensity of colouration increasing with increasing fluence level.

EXAMPLE 29

NIR Laser Imaging

A solution comprising 5 g N-ethylcarbazole, 10 g of a solution of triarylsulphonium hexafluoroantimonate in propylene carbonate, 20 g copper hydroxide phosphate and 21 g polyvinylbutyrate in 64 g MEK was prepared. A uniform film of this material was applied to a substrate using a K-bar and allowed to dry thoroughly, resulting in a transparent colourless coating. A sample of this material was exposed to a broadband UV source for 5 seconds, resulting in development of a very pale beige colouration. Images were then written on the sample using an 810 nm 100 mW diode laser at different fluence levels. In each case a brown image developed, with the intensity of colouration increasing with increasing fluence level.

EXAMPLE 30

NIR Laser Imaging

Example 29 was repeated but using 21 g nitrocellulose instead of polyvinylbutyrate. Exposure to the broadband UV source resulted in development of a very pale green colouration. Images were then written in the sample using an 810 nm 100 mW diode laser at different fluence levels. In each case a green image developed, with the intensity of colouration increasing with increasing fluence level.

EXAMPLE 31

Water-based Dispersion

A solution comprising 5 g N-ethylcarbazole, 10 g of a solution of triarylsulphonium hexafluoroantimonate in propylene carbonate and 2 g polyvinyl alcohol in 18 g of water was prepared. A uniform film of this material was applied to a substrate using a K-bar and allowed to dry thoroughly, resulting in a transparent colourless coating. A sample of this material was exposed to a broadband UV source for 10 seconds, followed by heating at 90° C. for 1 minute, resulting in development of a grey/black colouration.

EXAMPLE 32

Polymeric Derivative

A solution comprising of 2 g polyvinylcarbazole and 4 g of a solution of triarylsulphonium hexafluoroantimonate in propylene carbonate, in 20 g of toluene, was prepared. A uniform film of this material was applied to a substrate using a K-bar and allowed to dry thoroughly, resulting in a transparent colourless coating. A sample of this material was exposed to a broadband UV source for 10 seconds, followed by heating at 90° C. for 1 minute, resulting in development of a green colouration.

The invention claimed is:

1. A method of forming a marking on a substrate, which comprises:

applying to the substrate a colorless or transparent composition comprising a charge-delocalization compound and a photoacid, wherein the charge-delocalization compound is of the formula $Ar_1$—X—$Ar_2$, wherein each Ar is an aromatic group and X is a heteroatom, wherein if X=N, it may be substituted by an alkyl or aromatic, wherein said alkyl or aromatic group is not vinylic, group, wherein the photoacid generates an acid on irradiation or heating, wherein the acid thus generated is capable of protonating the charge-delocalization compound, thereby forming a colored charge-transfer complex with said compound; and generating the acid in situ by irradiating the composition with a UV laser.

2. The method according to claim 1, wherein the generating is imagewise.

3. The method according to claim 1, wherein the composition additionally comprises a binder.

4. The method according to claim 1, wherein the composition additionally comprises a polymer as a matrix in which the charge-delocalization compound and photoacid are incorporated.

5. The method according to claim 1, wherein the charge-delocalization compound is an amine.

6. The method according to claim 5, wherein the amine is an indole.

7. The method according to claim 5, wherein the amine is a carbazole.

8. The method according to claim 1, wherein the composition is free of organic halide.

9. The method according to claim 1, wherein the substrate is selected from polymers, papers, and foils.

10. A method of forming a marking on a substrate, which comprises:

applying to the substrate at least two colorless or transparent compositions, wherein each composition comprises a charge-delocalization compound and a photoacid, wherein the charge-delocalization compound is of the formula $Ar_1$—X—$Ar_2$, wherein each Ar is an aromatic group and X is a heteroatom, wherein if X=N, it may be substituted by an alkyl or aromatic, wherein said alkyl or aromatic group is not vinylic, group, wherein the photoacid generates an acid on irradiation or heating, wherein the acid thus generated is capable of protonating the charge-delocalization compound, thereby forming a colored charge-transfer complex with said compound; and generating the acid in situ, by irradiating the composition with a UV laser;

wherein the marking comprises at least two colors or shades of color.

11. The method according to claim 10, wherein the generating is imagewise.

12. The method according to claim 10, wherein each composition additionally comprises a binder.

13. The method according to claim 10, wherein each composition additionally comprises a polymer as a matrix in which the charge-delocalization compound and photoacid are incorporated.

14. The method according to claim 10, wherein the charge-delocalization compound is an amine.

15. The method according to claim 14, wherein the amine is an indole.

16. The method according to claim 14, wherein the amine is a carbazole.

17. The method according to claim 10, wherein the composition is free of organic halide.

18. The method according to claim 10, wherein the substrate is selected from polymers, papers, and foils.

* * * * *

UNITED STATES PATENT AND TRADEMARK OFFICE

CERTIFICATE OF CORRECTION

PATENT NO. : 7,998,900 B2
APPLICATION NO. : 11/666919
DATED : August 16, 2011
INVENTOR(S) : Christopher Anthony Wyres and Nazir Khan It is certified that error appears in the above-identified patent and that said Letters Patent is hereby corrected as shown below:

In The Claims:

Column 8,
Line 3, claim 1, “aromatic,” should read --aromatic group--
Line 4, claim 1, “vinylic, group,” should read --vinylic, wherein--
Line 37, claim 10, “aromatic” should read --aromatic group--
Line 38, claim 10, “vinylic, group,” should read --vinylic, wherein--

Signed and Sealed this
Eighteenth Day of October, 2011

David J. Kappos

David J. Kappos
*Director of the United States Patent and Trademark Office*